United States Patent [19]

Foster

[11] 4,265,336

[45] * May 5, 1981

[54] CONVERTIBLE SINGLE-DOUBLE BELT CHECK-OUT COUNTER

[75] Inventor: Stephen W. Foster, North Java, N.Y.

[73] Assignee: Almor Corporation, Warren, Mich.

[ * ] Notice: The portion of the term of this patent subsequent to Jan. 8, 1997, has been disclaimed.

[21] Appl. No.: 64,214

[22] Filed: Aug. 6, 1979

Related U.S. Application Data

[63] Continuation of Ser. No. 863,796, Dec. 23, 1977, Pat. No. 4,182,433.

[51] Int. Cl.[3] ..... A47F 9/04

[52] U.S. Cl. ..... 186/66; 186/68; 198/632

[58] Field of Search ..... 186/1 AA, 1 V, 59, 60, 186/66, 68, 69; 198/538, 632, 860, 592, 835; 312/91, 97, 134, 306, 312

[56] References Cited

U.S. PATENT DOCUMENTS

| | | | |
|---|---|---|---|
| 3,376,758 | 4/1968 | MacKay | 198/835 X |
| 3,688,873 | 9/1972 | Potrafke | 186/1 AA |
| 3,690,411 | 9/1972 | Potrafke | 186/1 AA |
| 3,750,858 | 8/1973 | White | 198/632 |
| 3,960,420 | 6/1976 | Speraw et al. | 186/1 V X |
| 4,061,205 | 12/1977 | Musser | 186/1 V |

*Primary Examiner*—F. J. Bartuska

*Attorney, Agent, or Firm*—Cullen, Sloman, Cantor, Grauer, Scott & Rutherford

[57] ABSTRACT

A check-out counter formed of a forward check-out module, having a conveyor belt for transporting merchandise along the top thereof, and a rear bagging module having an upper merchandise receiving deck. The two modules are spaced apart and a stowable second conveyor unit is provided to bridge the space when desired to carry merchandise from the check-out module to the bagging module deck. The conveyor unit is formed of a pair of spaced apart rollers mounted upon opposite ends of a support frame and carrying an endless conveyor belt. One end of the unit is pivotally connected to the bagging module and the othe end is releasably latched to a rear edge of the check-out module. Thus, the unit may alternatively be extended between the modules for conveyor use or may be stowed, hanging downwardly from its pivots in a non-use position.

6 Claims, 13 Drawing Figures

FIG. 1
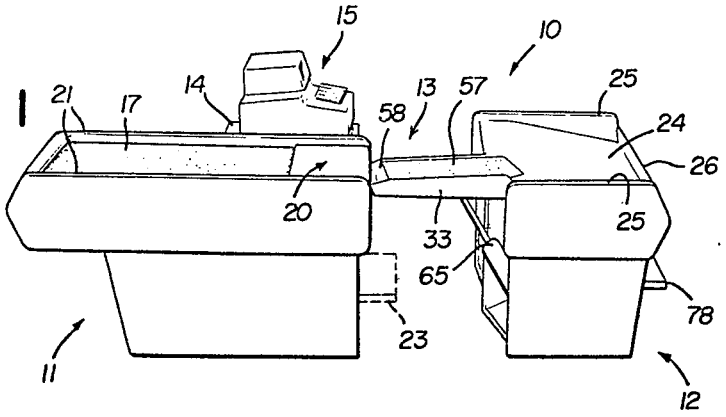
FIG. 2
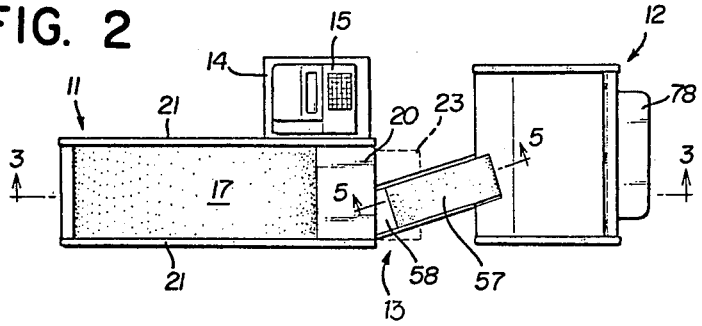
FIG. 3
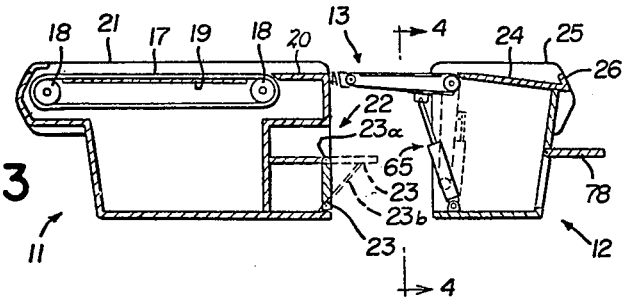
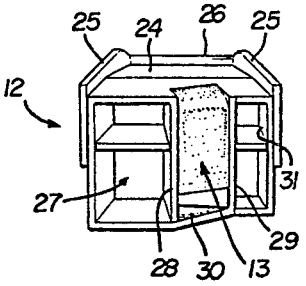
FIG. 4
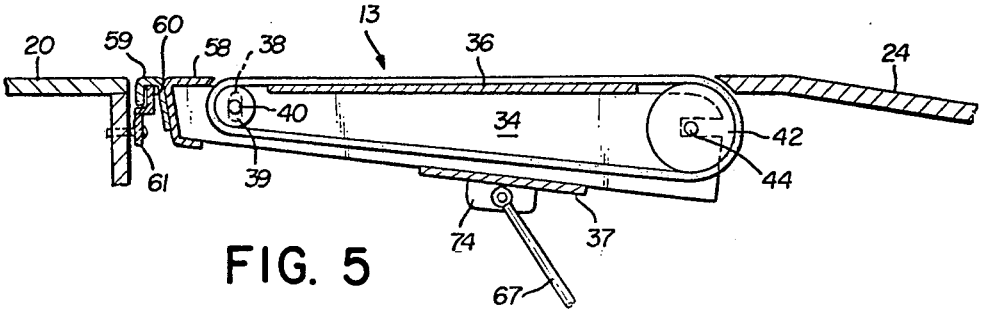
FIG. 5

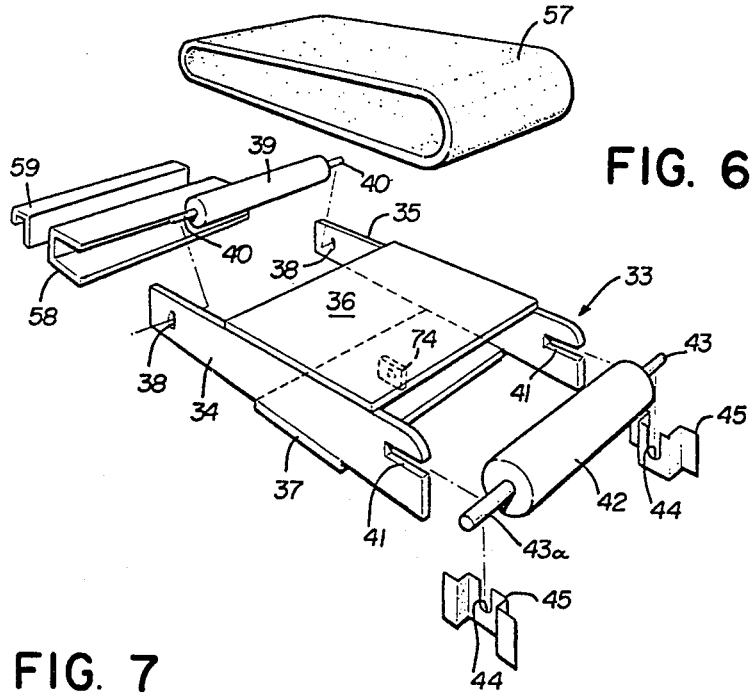
FIG. 6
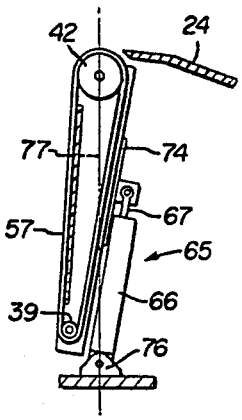
FIG. 11
FIG. 7
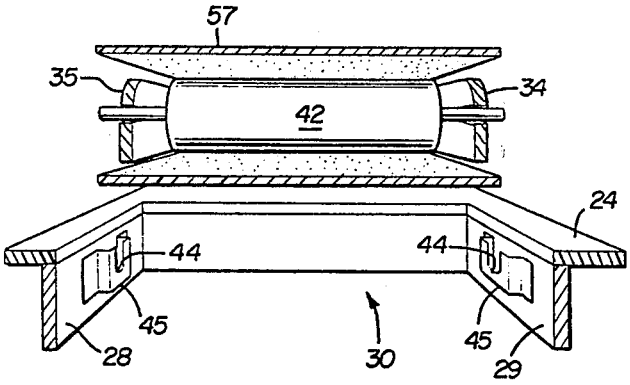
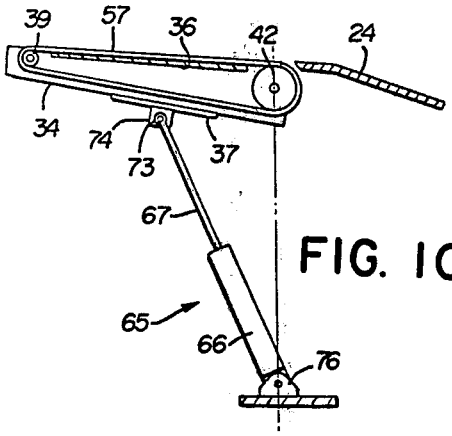
FIG. 10
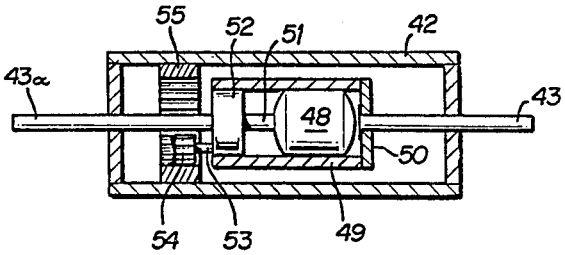
FIG. 8
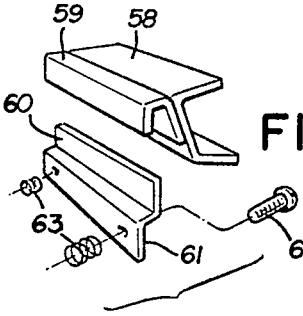
FIG. 9
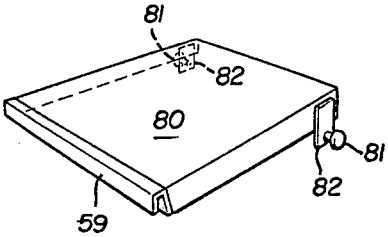
FIG. 13
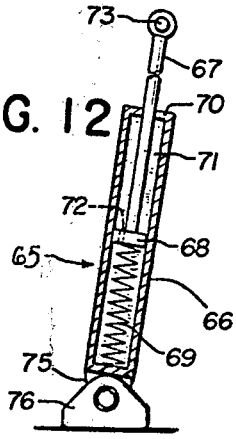
FIG. 12

CONVERTIBLE SINGLE-DOUBLE BELT CHECK-OUT COUNTER

This is a continuing application of Ser. No. 863,796, filed Dec. 23, 1977 now U.S Pat. No. 4,182,433.

BACKGROUND OF INVENTION

Conventional supermarket type check-out systems comprise an elongated counter arranged so that the customer places the merchandise upon a forward end and the merchandise is moved to and is checked by a so-called checker or cashier. Thereafter the merchandise is either bagged by the cashier or is moved to a bagging station for packaging by a bagger. One typical check-out system consists of a single belt type conveyor which extends the full length of the counter, i.e., from the forward customer loading end to the rear bagging end. Alternatively, counters are made with a single belt which extends from the foward end to the cashier station, with the rear bagging portion being formed either with a flat deck or a second conveyor belt.

In these types of constructions, the cashier or checker normally stands at roughly the mid-point of the counter on one side thereof and the cash register is located at the same side of the counter.

In order to speed the process of checking out the merchandise on the cash register, various scanner systems are becoming available which can automatically read pricing data imprinted upon each item of merchandise. These systems require mountings upon the check-out counter and connections with appropriate cash registers etc.

Thus, in the past it has been necessary to construct a check-out system essentially for a single purpose, i.e., a single belt type of check-out counter or a double belt type or alternatively a counter built to receive and mount one or another type of scanner system available for automatic checking.

Since the check-out systems in a market are built to last for a relatively long time, an investment by a market in a number of such single purpose systems makes it difficult for the market to change to another system as the market requirements change and as newer types of scanner or cash register equipment become available. Thus, it would be desirable to have adaptable check-out systems which can be easily converted or adapted to different needs during normal operation in the market as well as to accommodate various types of cash registers, scanners, etc. as newer equipment become available.

Hence, the invention herein relates to a check-out counter system which is adaptable in construction so that it can be selectively operated in different ways such as with one person acting as both cashier and bagger or two persons, i.e. a separate cashier and bagger, and utilizing either a one belt or two belt operation.

SUMMARY OF INVENTION

The invention herein contemplates a supermarket type check-out system provided with a pair of spaced apart modules, the forward one being a single belt system for conveying merchandise from the customer unload point to a checker or cashier, and the second module being a bagging module for use in receiving checked merchandise for later bagging by a separate bagging person or so-called bagger. The two modules are interconnected by a conveyor unit which is pivotally connected to the bagging module for extension towards the forward module or alternatively for stowing in an approximately vertical position, out of the way, for non-use. The conveyor unit is so made that it can be arranged at different heights relative to the horizontal so as to accommodate to varying heights of the forward module which thereby can be adjusted for different types of scanners used for checking out merchandise. Thus, the system can be used either as a single belt check-out system with a single cashier-checker who bags the merchandise while checking and who may use a scanner integrated with the counter. Alternatively, the counter may be used as a two belt check-out counter wherein checked merchandise is conveyed from the checker to the bagging module for subsequent bagging by the separate bagger person.

An object of the invention is to provide a conveyor belt unit which is self powered with a power unit integrated with one of the rollers and arranged for finger tip movement either into a roughly horizontal use position or into a substantially vertical non-use storage position. A counter-balance strut is preferably provided for assisting the checker in properly positioning the conveyor unit with little manual force.

Another object of this invention is to provide a convertible one belt-two belt check-out counter system which is adaptable to scanner type cash register check-outs and which can be used with either a one person checker or a two person checker-bagger team depending upon the work load. The system contemplates conversion from a one belt to a two belt system and vice versa in moments, without the need for any tools or separate equipment.

These and other objects and advantages of this invention will become apparent upon reading the following description, of which the attached drawings form a part.

DESCRIPTION OF DRAWINGS

FIG. 1 illustrates a perspective view of the check-out system herein.

FIG. 2 is a plan view of the complete system.

FIG. 3 illustrates a cross sectional view taken in the direction of arrows 3—3 of FIG. 2.

FIG. 4 is a perspective view of the bagging module, but with the conveyor belt in stowed position, taken in the direction of arrows 4—4 of FIG. 3.

FIG. 5 is an enlarged cross sectional view of the conveyor belt unit taken in the direction of arrows 5—5 of FIG. 2.

FIG. 6 is an enlarged, perspective view of the parts, shown disassembled, of the conveyor belt unit.

FIG. 7 is a fragmentary, perspective view of the bagging counter and conveyor belt connection, showing the conveyor belt unit lifted upwardly out of its supports.

FIG. 8 is a cross sectional view of the powered roller of the conveyor unit.

FIG. 9 is an enlarged, perspective view of a fragment of the latching system for latching the conveyor belt unit to the forward module.

FIG. 10 is a schematic, cross-sectional, view showing the conveyor belt unit arranged in its use position with its counter-balance strut.

FIG. 11 schematically illustrates the conveyor belt unit in its non-use position with the counter-balancing strut shown in its over the center position.

FIG. 12 is an enlarged, cross sectional view of the counter-balancing strut.

FIG. 13 is a perspective view of a panel-like unit for use in place of the conveyor belt unit.

DETAILED DESCRIPTION

The check-out counter 10 includes a merchandise unload-check-out module 11 behind which is a bagging module 12. The two modules are spaced apart a sufficient distance to provide a work space for a checker-cashier. A conveyor belt unit 13 interconnects the two modules. Along side the forward check-out module is located a cash register pedestal 14 upon which a cash register 15 is positioned.

The forward module preferably includes a conveyor belt 17 supported upon opposite rollers 18 and a suitable support plate 19 located beneath the upper reach of the belt for conveying merchandise from one end of the counter towards the other. Typically, customers, such as in a food market, unload their market baskets upon the conveyor belt 17 which is intermittently operated by the checker-cashier to bring the merchandise to her for check-out. The conveyor belt 17, which is conventional, is operated by a motor drive which is controlled by a cashier actuated switch, such as a floor pedal switch.

A flat transition plate 20 is located at the rear end of the module adjacent the checker. The plate may be a flat, solid plate upon which merchandise may be slid manually by the cashier during check-out and bagging. Alternatively, a scanner plate may be substituted, that is, a plate with suitable openings for an electronic scanner to automatically read price markings placed upon the merchandise.

The counter or module may be made with leg means for raising and lowering its height (not shown) so as to accomodate to various heights of scanner units or to provide an optimum height work surface for the cashier. This is a conventional means and therefore is not illustrated here. Also, side rails 21 are provided on the module to keep the merchandise upon the conveyor belt and avoid sidewise spillage.

The forward module may be made with appropriate cabinet shelving, such as shelf units 22, and a bagging shelf 23 hinged at **23*a* for either positioning vertically, i.e., out of the way, or horizontally so that the check-cashier can do her own bagging with one hand while operating the cash register with the other hand, when desired. The shelf 23 may be supported in horizontal position (see dotted lines in FIGS. 1, 2, and 3) by a conventional releasable brace or bracket 23*b* schematically shown in FIG. 3**.

The rear bagging module 12 includes an upper sloped bagging deck 24, side rails 25 and a rear rail 26 to receive merchandise from the checker. The module may include a shelf cabinet or portion 27 which may open forwardly and rearwardly to store bags which may be reached either from the front or the rear of the cabinet. The module also includes parallel vertical walls 28 and 29 which form a vertical belt receiving slot or area 30 along side of which is located vertically elongated storage shelf portion 31 for bags or the like.

The conveyor belt unit 13 is formed of a frame 33 (see FIG. 6) made of parallel, flat, sheet metal arms 34 and 35 to which are fastened an upper plate 36 and a lower plate 37 for rigidifying the frame. The arms, which are of different lengths, are provided with parallel, vertically elongated aligned slots 38. A roller 39 is arranged between the arms and the slots and spindles 40 mounted on the ends of the roller fit within the slots for rotation of the roller.

The opposite ends of the arms are provided with horizontally elongated slots 41. A power roller 42 is located between the slotted end portions of the arms and is provided with spindles 43 and **43*a* which extend through the slots 41 and fit within vertical slots 44 of support brackets 45 which are suitably mounted, as by mounting screws or the like (not shown) upon the parallel walls 28 and 29 of the bagging module. Thus, the spindles 43 and 43*a* pivotally support the frame 33 as well as supporting the power roller 42**.

An electric motor 48 is located within the power roller (see FIG. 8). The motor is mounted within a cylinder 49 having a bottom 50 connected to spindle 43. The drive shaft 51 of the motor drives a gear speed reducer 52 (schematically shown) which has an output shaft 53 upon which a small gear 54 is mounted. Such gear drives a ring gear 55 which is fastened within the roller 42 for rotating the roller relative to the spindles 43 and **43*a*. The spindle portion 43*a*** connects to the speed reducer for supporting the unit within the roller.

An endless belt 57 is arranged around the power roller 42 and the opposite roller 39 for driving the belt. The belt may be operated continuously or alternatively the motor may be actuated by a foot controlled pedal or switch so that the cashier can operate the belt whenever desired. Such types of controls are conventional and thus, it is not illustrated here.

As can be seen, the arm 34 is longer than the arm 35 in the drawings in order to permit the conveyor belt unit to be arranged at an angle relative to the transverse parallel edges of the forward and rear modules. Of course, the arms may be of the same length and thus the belt may be arranged perpendicular to the two units rather than at an angle as shown.

The free end of the conveyor unit is defined by a U-shaped bent channel 58 which is angled so as to close the gap between the end of the belt unit and the rear transverse edge of the forward module.

As shown in FIGS. 5 and 9, the free edge of the belt unit is latched to the transverse edge of the forward module by means of a downwardly opening U-shaped member 59 which is fastened to the channel 58 and which engages a tongue 60 on a strip which is bent to have a lower edge 61 fastened to the adjacent module edge by means of suitable screws 62 passing through springs 63. The springs permit forward and rearward movement of the strip 60 so as to permit the cashier-checker to lift the conveyor unit upwardly a short distance and then to manually move the strip 60 forwardly, out of the way. This permits the downwardly bent member 59 to clear the strip and thus permits the conveyor unit to drop downwardly for stowing, that is, for being suspended by the pivot forming spindles 43 and **43*a***.

To prevent the conveyor unit from simply dropping down by gravity and also to make it easier to raise the unit manually, a counter-balancing strut 65 is provided (see FIG. 12). Such strut is composed of an elongated cylinder 66 and an elongated rod 67 telescoped within the cylinder and having a piston portion 68 located within the cylinder and abutting one end of a spring 69 located within the cylinder. The upper end of the cylinder is closed by a closure 70 and preferably the cylinder is filled with oil 71 or the like fluid which may pass through one or more openings 72 formed in the piston 68 for thus resisting the movement of the piston within the cylinder and acting as a damper.

An eye ring 73 on the free end of the rod 67 is connected by a pin to a bracket or plate 74 fastened to the lower edge of the plate 37 of the frame 33. Likewise, the lower end of the cylinder is provided with a bracket 75 which pivotally connects to a bracket 76 fastened within the floor of the cabinet making up the bagging module.

As shown in FIG. 10, when the conveyor unit is raised, the strut rod 67 is extended from the cylinder so that when the unit is released or dropped, it slowly swings down into the vertical position until it finally reaches an over-center position as indicated by the dotted line 77 in FIG. 11 which thus helps to maintain the conveyor unit in its approximately vertical location and against swinging upwardly without a deliberate pull by the cashier-checker. The counter-balancing strut 65 including spring 69 and strut rod 67 assumes a spring-held, over-the-center relationship as illustrated in FIG. 11 to secure the conveyor unit in a substantially vertical non-operating position.

In operation, the cashier-checker is located between the forward and rear modules and may operate the check-out system as a single or double belt counter depending upon the amount of business to be handled. For single belt operation, the conveyor unit 13 is pivoted downwardly, out of the way, and the cashier does her own bagging at the rear end of the forward module. The shelf 23 is so located that the cashier can place merchandise into a bag supported on the shelf while ringing up the cash register with the other hand. The cashier also has access to bags stored in the shelf unit 22 in the forward module, and also those bags stored in the bagging module.

For double belt operation, the conveyor unit is swung upwardly so that its end is latched to the forward module. In this position, the cashier moves the merchandise from the transition plate 20 upon the conveyor belt 57 where it is conveyed to the bagging deck 24. A bagger located at the rear of the bagging module can then place the merchandise into bags. For that purpose, a rear bagging shelf 78 may be provided. (See FIG. 3)

If a scanner type of cash register is to be used, its sensing device may be located at or below the transition plate 20 for automatically reading the markings on the merchandise and thereby operating the cash register in response to such readings.

The conveyor belt unit may be adjusted to different heights, depending upon the relative heights of the forward module to the rear bagging module. This makes the unit adaptable to various types of scanning cash registers which are now becoming available on the market.

The conveyor unit frame side arms 34 and 35 and end channel 58 function as decorative outer surfaces for the belt unit, thus eliminating the need for an outer cover. The frame also contains or bounds all the conveyor parts for support as well as for handling the conveyor as a single piece which can be raised, lowered, removed, replaced, etc. In addition, as illustrated in FIG. 13, a flat planar surface, i.e. like a large wide board or panel 80, could be used in place of the belt conveyor unit to act as a slide or manually operated conveyor unit, upon which the merchandise can be manually slid from the forward module to the rear module. In such case, pins 81, which are secured to brackets 82 fastened to the sides of the panel, fit within and pivotally connect the panel to rear module support brackets 45, in place of the conveyor unit spindles 43 and 43*a*. The same U-shaped member 59 as is used on the belt conveyor unit is attached to the free end of the panel for releasable connection to the tongue 60 or strip 61, for holding the panel in a conveyor-acting position.

Having fully described an operative embodiment of this invention, I now claim:

1. A check-out counter comprising:

a forward check-out module, having a merchandize supporting surface and a rear transverse edge portion, a separate rear bagging module having a merchandize receiving deck and a forward transverse edge portion, said forward check-out module and said rear bagging module being spaced apart;

a conveyor belt unit for bridging the space between the modules and interconnecting the rear transverse edge portion of the check-out module with the forward transverse edge portion of the bagging module;

said conveyor belt unit being formed of a pair of spaced apart horizontally axised rollers secured within a rigid frame, and an endless conveyor belt passing around the rollers;

power means for rotating one of the rollers for thereby driving the conveyor belt;

means for pivotally securing one end of the conveyor belt unit to the forward transverse edge portion of said rear bagging module and releasable latch means for releasably securing the opposite end of said unit to said rear transverse edge portion of said check-out module, said rear bagging module including a conveyor belt unit receiving area consisting of opposed parallel vertical walls that form a vertical belt receiving slot wherein said unit may be stowed in said rear bagging module whereby the conveyor belt unit may be hung downwardly from said pivot means for stowing in a non-use position and may alternatively be extended and secured between the modules in a use position for conveying merchandize from the check-out module to the bagging module;

said pivotal securing means including axially aligned, oppositely extending mounting spindles for rotatably supporting the roller which is adjacent the bagging module and mounting brackets for pivotally connecting said spindles to the forward transverse edge portion of said rear bagging module between said opposed parallel walls of said bagging module belt receiving slot; and said power means including a drive motor mounted within the roller which is adjacent the bagging module for rotating said roller upon the mounting spindles, said rigid frame also being supported upon said mounting spindles and mounting brackets and said pivotal securing means providing both pivotal securement of the conveyor unit to the rear bagging module and support for said drive motor.

2. A check-out counter as defined in claim 1, and said conveyor belt unit being considerably narrower than the modules and being located near one side of the modules, so that the modules and the extended belt unit form a roughly U-shaped arrangement to provide a work space for a checker.

3. A check-out counter as defined in claim 1, and said check-out module having a built-in merchandize carrying conveyor belt forming at least a part of its support surface.

4. A convertible single-double check-out counter comprising:

a forward check-out module having a built-in conveyor belt for transporting merchandize upon the module to a checker working at the rear transverse edge portion of the module;

a rear bagging module having a forward transverse portion spaced rearwardly of the check-out module and having a bagging deck for received checked merchandize for bagging by separate bagger;

a conveyor belt unit for optionally bridging the space between the modules and interconnecting the respective transverse edge portions;

said conveyor belt unit including a first roller having opposite end, axial, mounting spindles supported by support members secured upon the bagging module transverse edge portion, an elongated support frame also mounted upon said spindles for pivotal support from the bagging module, and a second roller rotatably mounted upon the opposite, free end of the frame, and an endless conveyor belt extending around the rollers, said bagging module including a conveyor belt unit receiving area consisting of opposed parallel vertical walls that form a vertical belt receiving slot, wherein said conveyor belt unit may be stowed in the bagging module;

cooperating releaseable latch members carried by the check-out module and the conveyor belt unit;

power means for rotating the rollers to thereby drive the belt extending around them, said power means including a drive motor mounted within said first roller for rotating said roller upon the mounting spindles, said conveyor belt unit being pivotally supported between said opposed parallel walls of said belt receiving slot and said support members providing both pivotal securement of said conveyor belt unit to the rear bagging module and support for said drive motor;

whereby the counter may be used as a single belt check-out counter with the conveyor belt unit stowed in a vertical non-use position in said conveyor belt unit receiving area, hung downwardly from the mounting spindles and the checker may work in the space between the modules for checking and bagging the merchandize and alternatively, the counter may be used as a two-belt check-out counter with the conveyor belt unit extended between the modules for carrying checked merchandize to the bagging module deck for packaging for a separate bagger.

5. The convertible check-out counter as defined in claim 4 wherein said drive motor including a drive shaft which is connected to a speed reducer having an output shaft upon which a gear is mounted, said gear driving a ring gear mounted within the roller for rotating the roller and one of said spindles being connected to said speed reducer.

6. The convertible check-out counter as defined in claim 5 wherein the free end of said frame is latched to the rear transverse edge portion of said forward module by a downwardly opening U-shaped member which is fastened to said frame and engages a strip which is fastened to said forward module, said strip mounted to said forward module by spring means to permit forward and rearward movement of said strip so as to permit the U-shaped member to clear the strip whereby the conveyor belt unit may drop downwardly for stowing.

* * * * *